United States Patent [19]

Radnis

[11] Patent Number: 5,067,853

[45] Date of Patent: Nov. 26, 1991

[54] OSCILLATING PLOW APPARATUS

[76] Inventor: Bernard Radnis, 7533 Garden Ln. Ave., Justice, Ill. 60458

[21] Appl. No.: 554,563

[22] Filed: Jul. 19, 1990

[51] Int. Cl.[5] ..... F16L 1/00; E02F 5/10

[52] U.S. Cl. ..... 405/182; 37/DIG. 18; 172/40; 405/174

[58] Field of Search ..... 405/182; 37/DIG. 18; 172/40–42; 404/117

[56] References Cited

U.S. PATENT DOCUMENTS

| | | | |
|---|---|---|---|
| 3,326,010 | 6/1967 | Gagne | 405/182 |
| 3,516,260 | 6/1970 | Wood | 405/182 |
| 3,757,869 | 9/1973 | Gagne | 37/DIG. 18 |
| 4,050,260 | 9/1977 | Lemay | 172/40 X |
| 4,685,832 | 8/1987 | Decker | 405/182 X |

*Primary Examiner*—Dennis L. Taylor
*Attorney, Agent, or Firm*—Leon Gilden

[57] ABSTRACT

An apparatus wherein a platform mounts a drive motor that directs rotary motion to an eccentrically arranged crank pin to effect oscillating motion to a blade member directed downwardly relative to the platform. The blade includes a foot member that is formed with a conically tapered forward end and a reduced cylindrical rear end to permit securement of a conduit hose to the rear end to pull the conduit hose in a conduit laying procedure.

8 Claims, 5 Drawing Sheets

PRIOR ART

OSCILLATING PLOW APPARATUS

BACKGROUND OF THE INVENTION

1. Field of the Invention

The field of invention relates to plow structure, and more particularly pertains to a new and improved oscillating plow apparatus wherein the same conveniently and compactly provides an organization permitting the depositing and positioning of a conduit hose in a below ground level surface orientation.

2. Description of the Prior Art

The prior art has provided various digging and trenching apparatus for providing a trench or the positioning of various cables within a below surface orientation. Examples of such prior art structure may be found in U.S. Pat. No. 3,420,317 to Ryan wherein a blade structure is mounted to a support beam, and the blade includes a rotary cutter point of a spiral configuration that is rotated upon its being directed through an underground orientation relative to the blade.

U.S. Pat. No. 4,463,509 to Leonard provides a plow structure utilizing a vibratory mechanism to effect vibratory motion to an associated plow structure.

U.S. Pat. No. 4,377,914 to Draney, et al. provides for a blade control organization utilizing hydraulic mechanism to effect desired positioning of an associated blade structure.

U.S. Pat. No. 2,169,079 to Bosworth, et al. provides a trenching tool utilizing a series of blades mounted to a central drive hub to effect a trenching operation upon directing the organization above a desired trenching line.

U.S. Pat. No. 3,508,616 to Hubbard provides a trenching organization utilizing vibratory means to enhance a trenching operation.

As such, it may be appreciated that there continues to be a need for a new and improved oscillating plow apparatus wherein the same addresses both the problems of ease of use as well as effectiveness in construction in the directing and positioning of a conduit hose organization in a below ground level orientation and in this respect, the present invention substantially fulfills this need.

SUMMARY OF THE INVENTION

In view of the foregoing disadvantages inherent in the known types of plow apparatus now present in the prior art, the present invention provides an oscillating plow apparatus wherein the same directs oscillatory motion to a foot member to permit securement of a conduit hose to the foot member and positioning of a conduit in a below the ground orientation. As such, the general purpose of the present invention, which will be described subsequently in greater detail, is to provide a new and improved oscillating plow apparatus which has all the advantages of the prior art plow apparatus and none of the disadvantages.

To attain this, the present invention provides an apparatus wherein a platform mounts a drive motor that directs rotary motion to an eccentrically arranged crank pin to effect oscillating motion to a blade member directed downwardly relative to the platform. The blade includes a foot member that is formed with a conically tapered forward end and a reduced cylindrical rear end to permit securement of a conduit hose to the rear end to pull the conduit hose in a conduit laying procedure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved oscillating plow apparatus which has all the advantages of the prior art plow apparatus and none of the disadvantages.

It is another object of the present invention to provide a new and improved oscillating plow apparatus which may be easily and efficiently manufactured and marketed.

It is a further object of the present invention to provide a new and improved oscillating plow apparatus which is of a durable and reliable construction.

An even further object of the present invention is to provide a new and improved oscillating plow apparatus which is susceptible of a low cost of manufacture with regard to both materials and labor, and which accordingly is then susceptible of low prices of sale to the consuming public, thereby making such oscillating plow apparatus economically available to the buying public.

Still yet another object of the present invention is to provide a new and improved oscillating plow apparatus which provides in the apparatuses and methods of the prior art some of the advantages thereof, while simultaneously overcoming some of the disadvantages normally associated therewith.

Still another object of the present invention is to provide a new and improved oscillating plow apparatus wherein the same permits convenience of securement of an associated conduit hose to a foot member to permit directing of the conduit hose in a below the ground level orientation by directing the foot member through the ground by means of oscillatory motion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
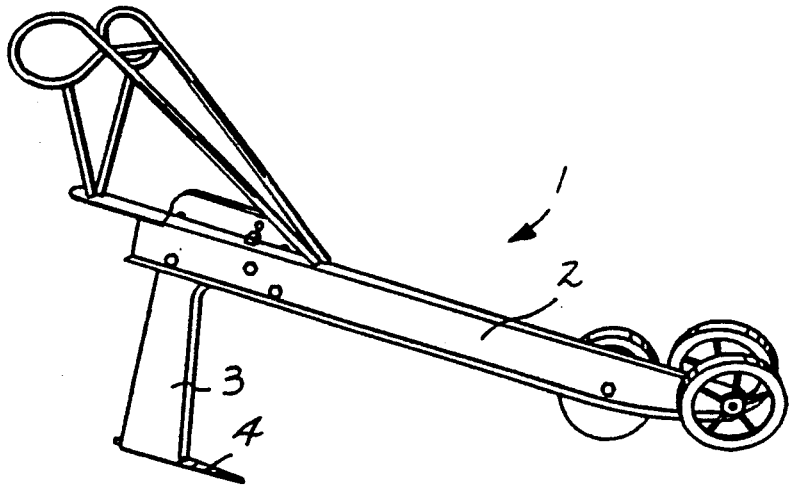
FIG. 1 is an isometric illustration of a prior art plow type apparatus.

With reference now to the drawings, and in particular to FIGS. 1 to 10 thereof, a new and improved oscillating plow apparatus embodying the principles and concepts of the present invention and generally designated by the reference numeral 10 will be described.

Figure 2:
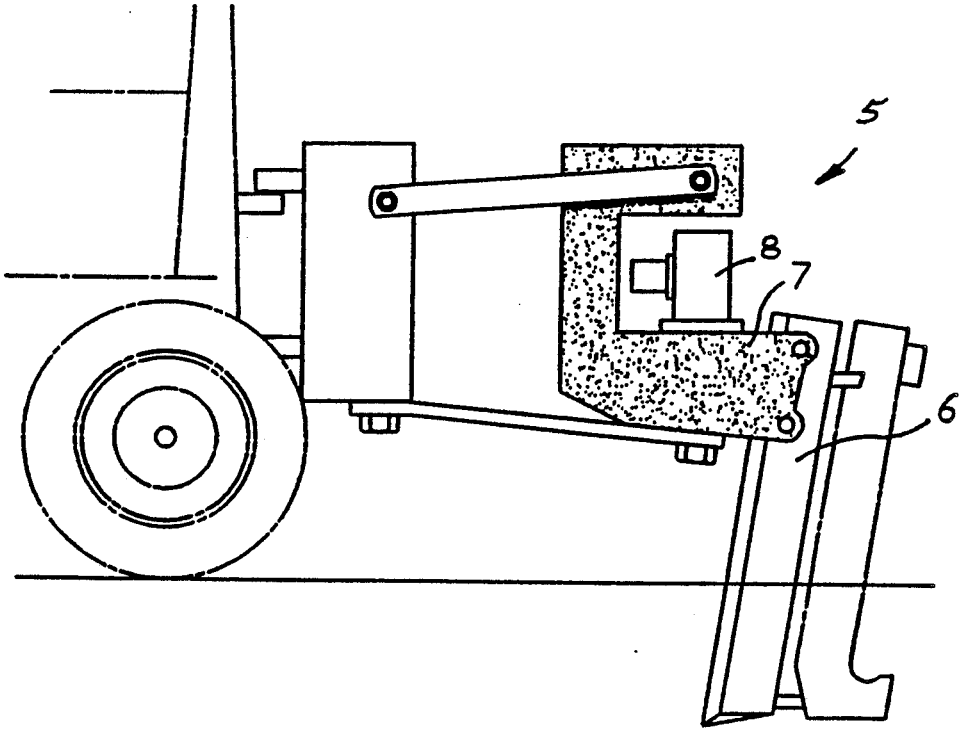
PRIOR ART FIG. 2
FIG. 2 is an orthographic view, taken in elevation, of a further prior art plow apparatus.
Figure 3:
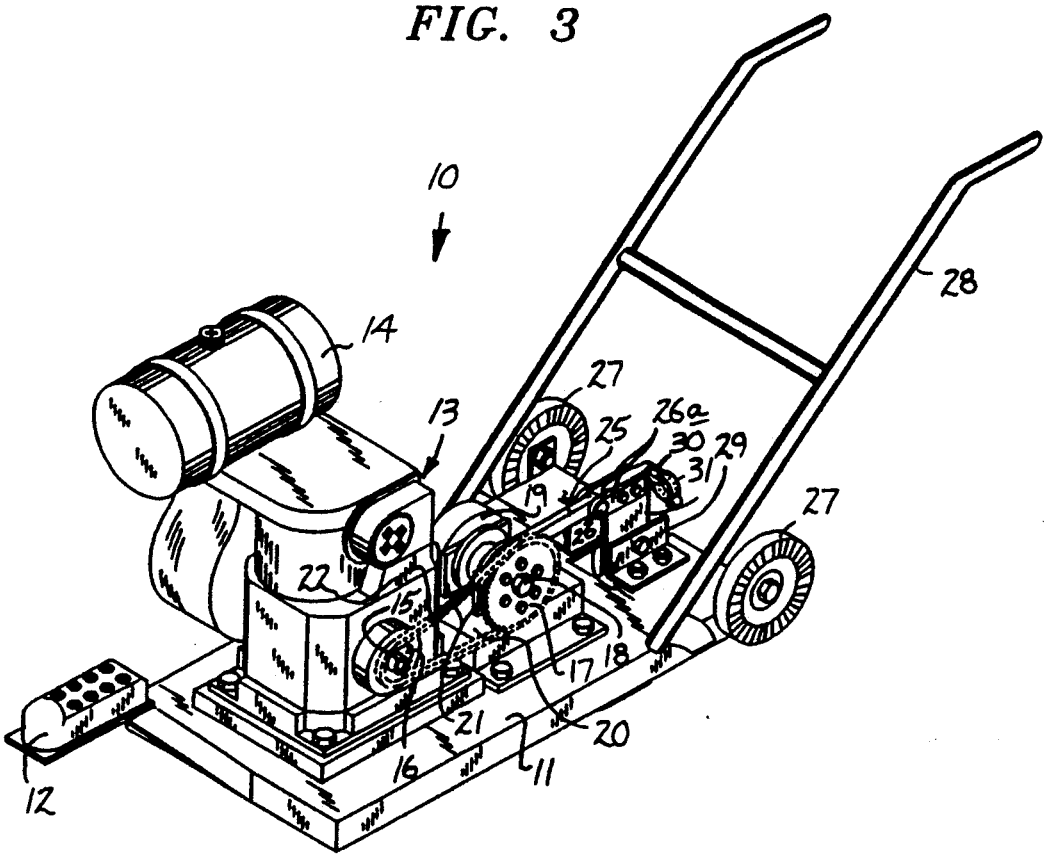
FIG. 3 is an isometric illustration of the instant invention.
Figure 4:
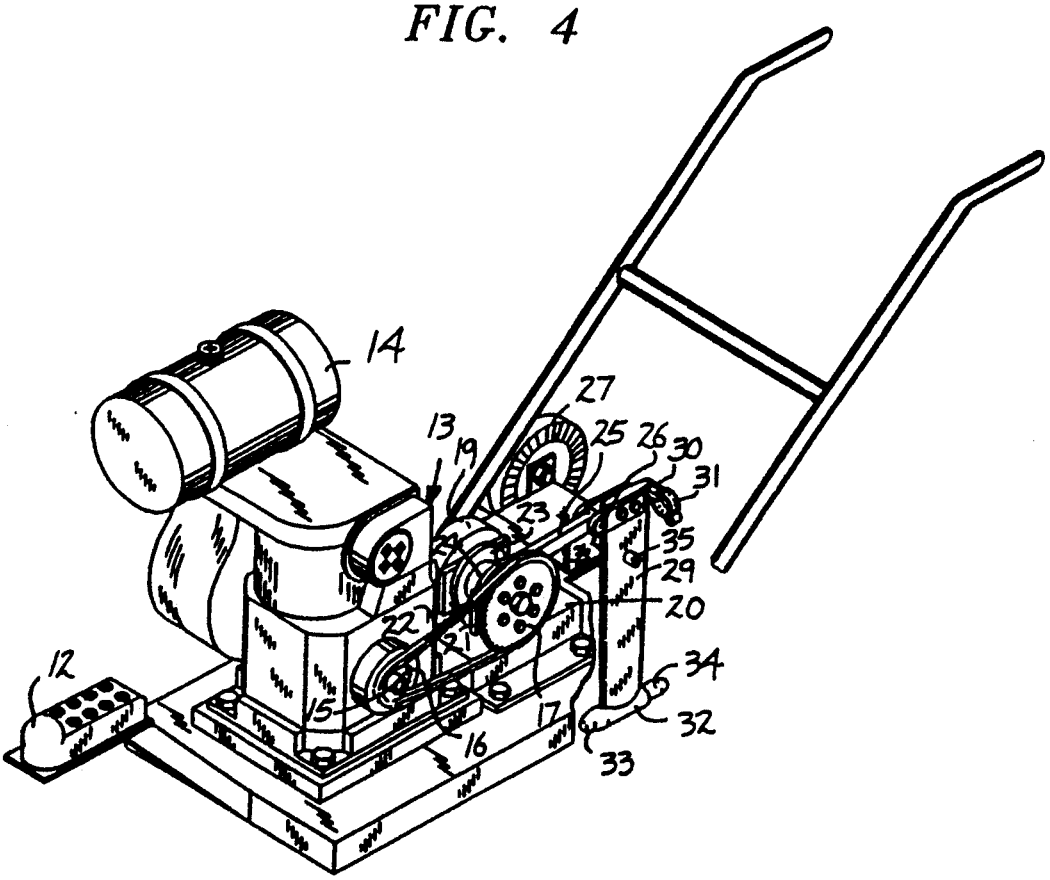
FIG. 4 is an isometric illustration of the instant invention, partially in section to illustrate the structural association of the oscillating beam and associated foot member relative to the apparatus.
Figure 5:
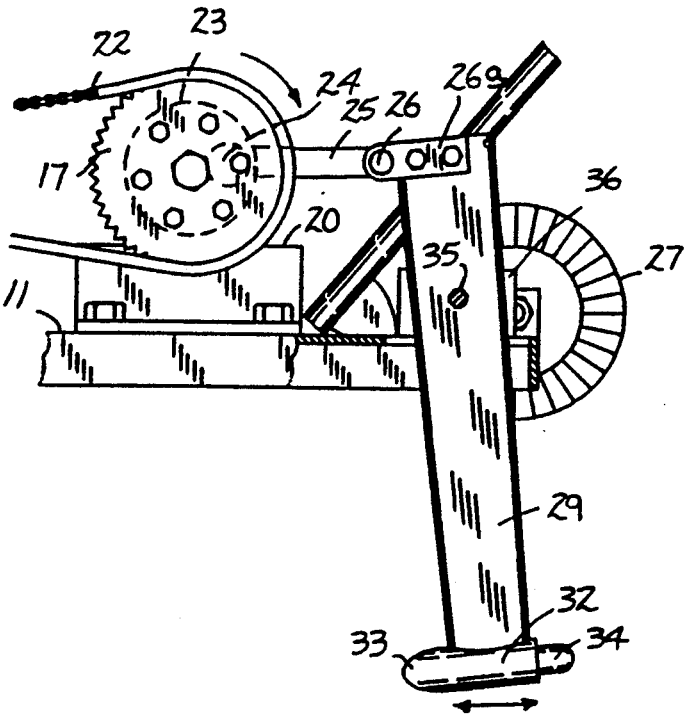
FIG. 5 is an orthographic view, taken in elevation, of the oscillating beam structure.
Figure 6:
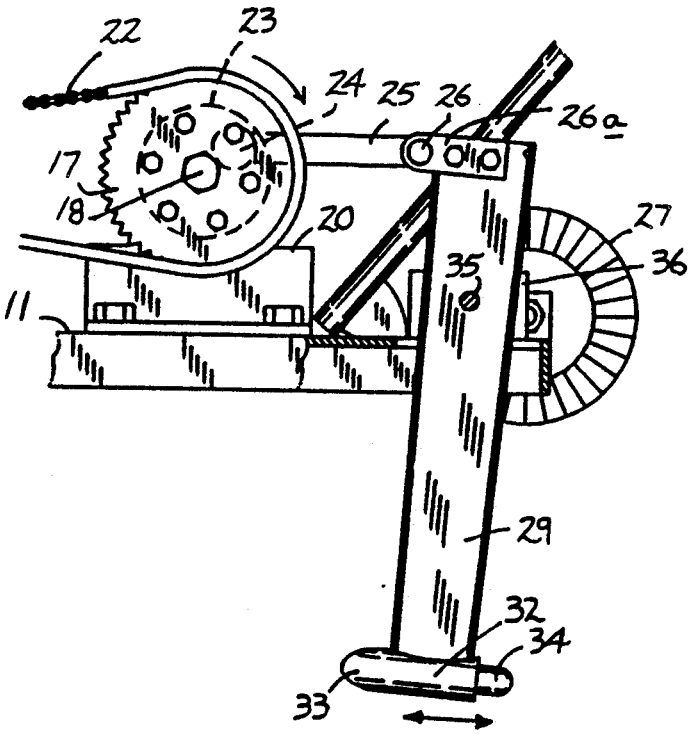
FIG. 6 is a further orthographic view, taken in elevation, of the oscillating beam structure.
Figure 7:
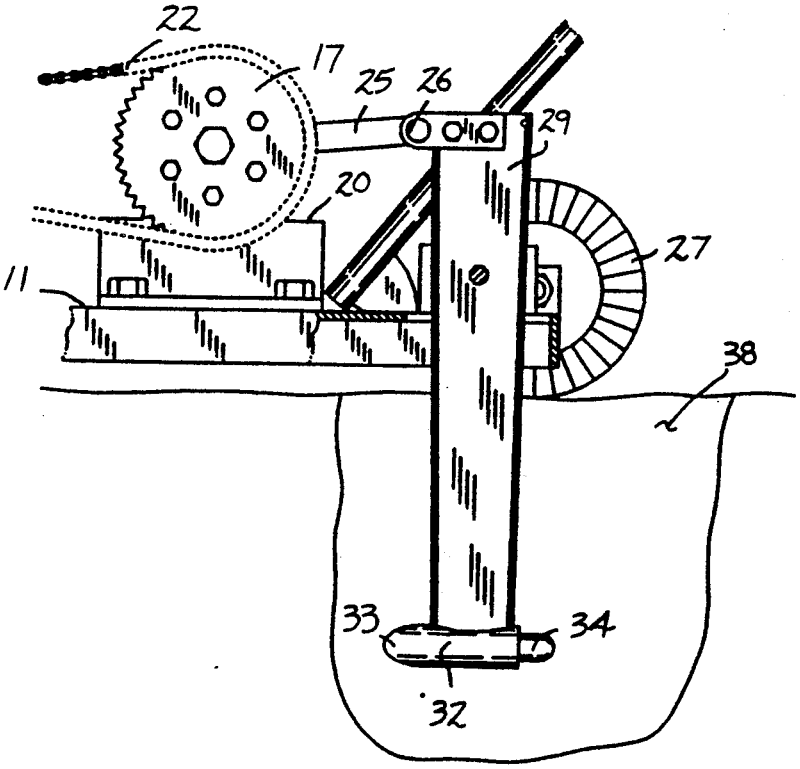
FIG. 7 is an orthographic view, taken in elevation, of the oscillating beam structure in initial positioning in a hole.

FIG. 1 illustrates a prior art plow structure 1, wherein an elongate support beam 2 includes wheels mounted at its forward end and handles at its rear end, with a blade member 3 directed downwardly relative to the beam and a rotary spiral cutter mounted orthogonally relative to the beam. FIG. 2 illustrates a further prior art plow apparatus 5, wherein a plow 6 mounted to a support member 7 includes a vibratory mechanism 8 to effect vibratory translation to the plow 6 to enhance its operation.

Figure 8:
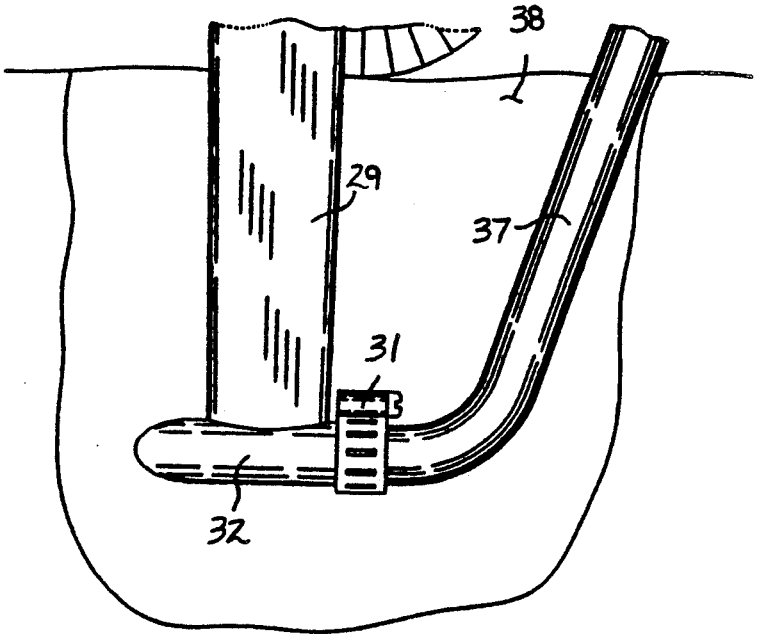
FIG. 8 is an orthographic view, taken in elevation, of a conduit hose mounted to the oscillating foot member within the positioning hole.
Figure 9:
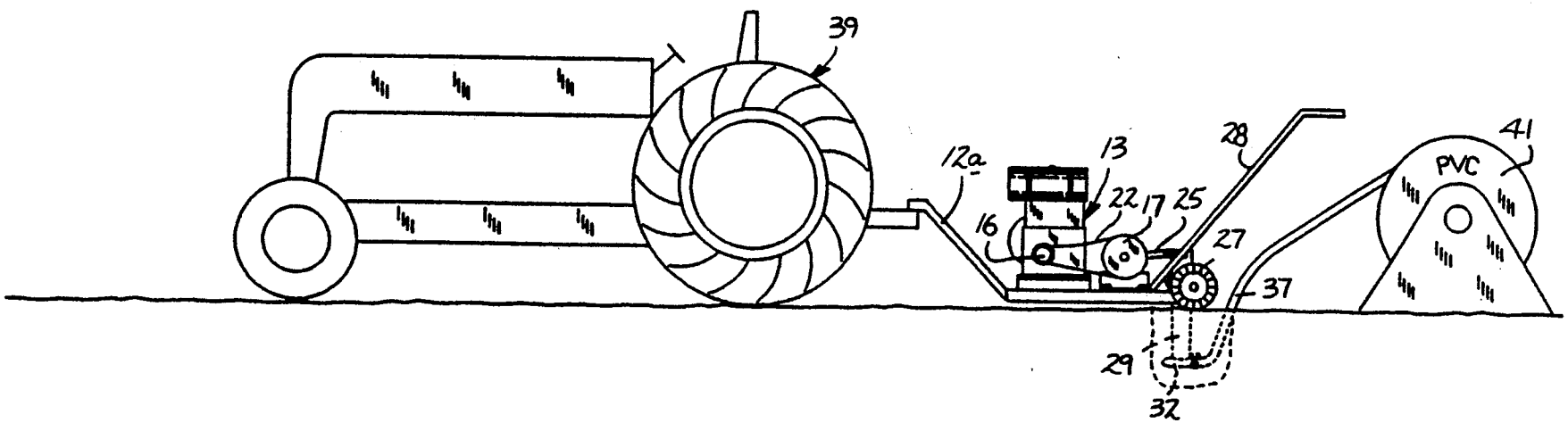
FIG. 9 is an orthographic side view, taken in elevation, of the organization in preparation for directing the conduit hose in a below surface ground orientation.
Figure 10:
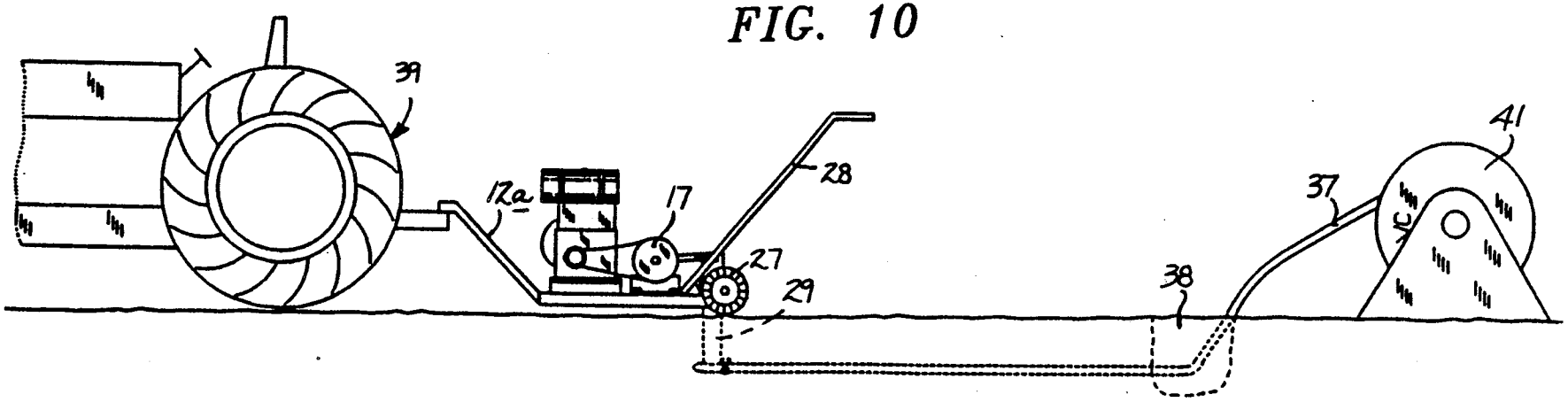
FIG. 10 is an orthographic side view, taken in elevation, of the conduit hose being directed in a below surface ground orientation.

More specifically, the oscillating plow apparatus 10 of the instant invention essentially comprises a platform 11, with a yoke member 12 mounted to a forward end of the platform 11 for securement to an associated tow vehicle, such as illustrated in FIGS. 9 and 10. The yoke member is set forth as a modified yoke member 12*a* in FIG. 10 to accommodate securement to the tractor organization 39, as illustrated. A drive motor 13 is fixedly mounted to the platform 11, with a fuel tank 14 secured thereto for permitting continuous operation of the drive motor 13. A motor output shaft 15 is directed exteriorly of the drive motor 13 and includes a drive sprocket 16 coaxially and orthogonally mounted to the output shaft 15. The support plate 20 arranged rearwardly of the drive motor 13 on the support platform includes a plurality of spaced bearing plates 21 orthogonally and integrally mounted to the support plate 20 to include a driven shaft 18 arranged parallel to and rearwardly of the output shaft 15 to the driven shaft 18 directed through the bearing plates 21. A forward end of the driven shaft 18 includes a driven sprocket 17 arranged in a single plane with the forwardly positioned drive sprocket 16. A drive chain 22 operably associates the drive sprocket 16 and a driven sprocket 17 as illustrated. At least one counter-weight 19 is mounted to the driven shaft 18, wherein a further counter-weight may be mounted to the driven sprocket 17 to minimize vibration in use of the organization. The driven shaft 18 includes an eccentric crank pin 24 mounted between spaced crank plates 23 that are in turn coaxially mounted to the driven shaft 18. The eccentric crank pin includes a connecting rod 25 mounted at a forward end thereof to the crank pin 24, with a rear connecting end of the connecting rod 25 pivotally mounted between spaced bearing flanges 26*a*, with an associated pivot shaft directed through the bearing flanges 26*a* securing the rear end of the connecting rod 26 thereto. The bearing flanges 26 are fixedly mounted to an upper terminal end of an elongate oscillating beam 29 directed downwardly from a postion above the support platform to a position below the support platform 11 as illustrated. A plurality of spaced parallel pivot axle support plates 36 are mounted to the support platform rearwardly of the support plate 20 to align the oscillating beam 29 with the eccentric crank pin 24. A pivot axle 35 is directed through the oscillating beam 29 adjacent the upper terminal end thereof, with the pivot axle 35 orthogonally mounted through the spaced parallel pivot axle support plates 36. A support ring 30 is also mounted at the upper terminal end of the oscillating beam 29 to removably mount an associated clamp 31 for use in clamping a conduit hose 37, in a manner to be described in more detail below and as illustrated in FIG. 8 for example. A lower terminal end of the elongate oscillating beam 29 includes an oscillating foot 32 orthogonally mounted to the lower terminal end of the oscillating beam 29 in alignment with the connecting rod 25 and associated drive and driven sprockets 16 and 17 respectively to align the oscillating foot 32 and minimize destructive vibration effected by oscillation of the beam 29 and foot 32 in use. The oscillating foot member 32 includes a conically tapered forward end 33 to enhance directing of the foot member through a below ground level working forum, and includes a cylindrical rear end shaft 34 defined by a predetermined diameter less than a predetermined width of the foot 32. It is understood that the cylindrical rear end shaft 34, as well as the oscillating foot 32, are coaxially aligned. It should be further noted that a plurality of rear support wheels 27 are mounted to opposed side rear portions of the platform 11, with the axis of the wheels arranged generally parallel to the driven shaft 18. A handle bar assembly 28 is mounted to the support platform 11, including a plurality of spaced parallel grasping bars to permit manual guidance of the assembly during use.

Reference to FIGS. 8–10 illustrates the use of a conduit hose 37 mounted onto the cylindrical rear end shaft 34 utilizing the clamp 31 to secure the conduit hose 37 thereon, with a lower terminal portion of the oscillating beam 29, as well as the oscillating foot 32, directed within a position hole 38 to initiate use of the organization. The tow vehicle 39 pulls the apparatus forwardly and upon actuation of the drive motor 13, oscillating motion is directed to the oscillating foot 32 as it directs the conduit hose in a below surface orientation, as illustrated in FIG. 10.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An oscillating plow apparatus comprising, in combination, a platform, the platform including a yoke means mounted at a forward end of the platform for securement of the platform to an associated tow vehicle, and a drive motor mounted on the platform rearwardly of the yoke means, and the drive motor including an output shaft, the output shaft including a drive sprocket orthogonally mounted to the output shaft, and a driven shaft rotatably mounted on the platform rearwardly of the drive motor in a parallel relationship to the output shaft, the driven shaft including a driven sprocket mounted on the driven shaft, wherein the driven sprocket is arranged in a common plane with the drive sprocket, and a drive chain in operative communication with the driven sprocket and the drive sprocket, and the driven sprocket including an eccentric crank pin, the crank pin including a connecting rod directed rearwardly of the crank pin, and the connecting rod including a rear connecting rod end, and an oscillating beam mounted orthogonally through the platform rearwardly of the driven shaft, with the rear connecting rod end mounted at an upper terminal end of the oscillating beam, the oscillating beam pivotally mounted to the platform underlying the connecting rod, and the oscillating beam including an oscillating foot orthogonally mounted to a lower terminal end of the oscillating beam.

2. An apparatus as set forth in claim 1 wherein the oscillating beam is elongate, wherein the oscillating beam medially intersects the oscillating foot, the oscillating foot is coaxially aligned and is arranged generally for oscillation within a single oscillating plane, wherein the oscillating plane is arranged generally parallel to the common plane defined by the drive sprocket and driven sprocket.

3. An apparatus as set forth in claim 2 wherein the support platform includes a plurality of wheels mounted to opposed side walls of the platform, wherein the wheels each include a wheel axis, wherein each wheel axis is arranged generally orthogonally to the common plane.

4. An apparatus as set forth in claim 3 further including a support plate, wherein the support plate is positioned rearwardly of the drive motor, the support plate including a plurality of spaced bearing plates orthogonally and integrally mounted to the support plates, wherein the bearing plates rotatably mount the driven shaft.

5. An apparatus as set forth in claim 4 wherein the driven shaft further includes at least one counter-weight mounted on the driven shaft positioned remotely from the driven sprocket, and a plurality of spaced parallel crank plates mounted about the driven shaft interiorly of the crank plates, with the eccentric crank pin positioned between the spaced crank plates.

6. An apparatus as set forth in claim 5 further including a plurality of spaced parallel pivot axle support plates, the pivot axle support plates including a pivot axle directed orthogonally therethrough, wherein the pivot axle support plates positioned rearwardly of the support plate and wherein the pivot axle is arranged to pivotally mount the oscillating beam.

7. An apparatus as set forth in claim 6 wherein the coaxially aligned oscillating foot includes a conically tapered forward end and a main body, wherein the main body is defined by a predetermined width, and the oscillating foot further includes a cylindrical rear end shaft defined by a predetermined diameter less than that defined by the predetermined width to secure a conduit hose thereon.

8. An apparatus as set forth in claim 7 further including a support ring mounted to the support beam at the upper terminal end of the support beam, wherein the support ring removably mounts a clamp for securing the conduit hose about the cylindrical rear end shaft.

* * * * *